US010145381B2

(12) United States Patent
Miyata et al.

(10) Patent No.: US 10,145,381 B2
(45) Date of Patent: Dec. 4, 2018

(54) GEARED CENTRIFUGAL COMPRESSOR WITH PRESSURE ADJUSTMENT PORTION TO BALANCE AXIAL THRUST

(71) Applicant: MITSUBISHI HEAVY INDUSTRIES COMPRESSOR CORPORATION, Tokyo (JP)

(72) Inventors: Hiroyuki Miyata, Hiroshima (JP); Hideki Nagao, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 371 days.

(21) Appl. No.: 14/893,320

(22) PCT Filed: Jan. 23, 2014

(86) PCT No.: PCT/JP2014/051401
§ 371 (c)(1),
(2) Date: Nov. 23, 2015

(87) PCT Pub. No.: WO2015/111169
PCT Pub. Date: Jul. 30, 2015

(65) Prior Publication Data
US 2016/0131155 A1 May 12, 2016

(51) Int. Cl.
*F04D 29/051* (2006.01)
*F04D 29/58* (2006.01)
(Continued)

(52) U.S. Cl.
CPC ..... *F04D 29/051* (2013.01); *F04D 17/12* (2013.01); *F04D 25/163* (2013.01);
(Continued)

(58) Field of Classification Search
CPC ..... F04D 29/464; F04D 29/0516; F04D 29/4206; F04D 29/286; F04D 29/053;
(Continued)

(56) References Cited

U.S. PATENT DOCUMENTS 2,814,254 A * 11/1957 Litzenberg ..... F04D 1/06 310/54
3,861,820 A * 1/1975 Hornschuch ..... F04D 25/163 403/383
(Continued)

FOREIGN PATENT DOCUMENTS

EP 0 512 568 A1 11/1992
GB 842722 A * 7/1960 ..... F04D 17/14
(Continued)

OTHER PUBLICATIONS

International Search Report, issued in PCT/JP2014/051401, dated Apr. 15, 2014.
(Continued)

*Primary Examiner* — David E Sosnowski
*Assistant Examiner* — Topaz L Elliott
(74) *Attorney, Agent, or Firm* — Birch, Stewart, Kolasch & Birch, LLP

(57) ABSTRACT

A centrifugal compressor includes a driving shaft (2) which is rotationally driven, a driving gear (11) which is connected to the driving shaft (2), a driven gear (12, 13) to which rotation of the driving gear (11) is transmitted, a driven shaft (3) which extends toward both end sides in a center axis direction of the driven gear (12, 13), a first compression portion (41) which is provided on a first end portion side in the center axis direction of the driven shaft (3), a second compression portion (42) which is provided on a second end portion side in the center axis direction of the driven shaft (3), and a pressure adjustment portion (7) which uniformly
(Continued)

adjusts a pressure of a space of a discharge side of a fluid in the first compression portion (41) and a pressure of a space of a discharge side of a fluid in the second compression portion (42).

6 Claims, 4 Drawing Sheets

(51) Int. Cl.

| | |
|---|---|
| ***F04D 29/28*** | (2006.01) |
| ***F04D 29/053*** | (2006.01) |
| ***F04D 29/42*** | (2006.01) |
| ***F04D 25/16*** | (2006.01) |
| ***F01D 17/12*** | (2006.01) |
| ***F04D 17/12*** | (2006.01) |

(52) U.S. Cl.
CPC ..... *F04D 29/053* (2013.01); *F04D 29/0516* (2013.01); *F04D 29/286* (2013.01); *F04D 29/4206* (2013.01); *F04D 29/5826* (2013.01)

(58) Field of Classification Search
CPC .. F04D 29/5826; F04D 29/051; F04D 25/028; F04D 25/163; F04D 17/12; F04D 1/06; F04D 1/063; F04D 1/066
USPC ..... 415/101–107
See application file for complete search history.

(56) References Cited

U.S. PATENT DOCUMENTS

| | | | | |
|---|---|---|---|---|
| 4,715,778 | A | 12/1987 | Katayama et al. | |
| 4,725,196 | A | 2/1988 | Kaneki et al. | |
| 5,154,571 | A | 10/1992 | Prümper | |
| 5,382,132 | A * | 1/1995 | Mendel | F04D 25/163 415/122.1 |
| 5,485,719 | A * | 1/1996 | Wulf | F02C 3/107 415/66 |
| 8,939,732 | B2 * | 1/2015 | Kim | F04D 17/12 417/243 |
| 2012/0100015 | A1 * | 4/2012 | Kim | F04D 17/12 417/244 |

FOREIGN PATENT DOCUMENTS

| | | | |
|---|---|---|---|
| JP | 63-75392 | A | 4/1988 |
| JP | 5-18394 | A | 1/1993 |
| JP | 2000-28169 | A | 1/2000 |
| JP | 2005-248832 | A | 9/2005 |
| JP | 2012-516403 | A | 7/2012 |
| JP | 2013-36375 | A | 2/2013 |
| JP | 2013-83168 | A | 5/2013 |
| WO | WO 2010/086009 | A1 | 8/2010 |

OTHER PUBLICATIONS

Written Opinion of the International Searching Authority, issued in PCT/JP2014/051401, dated Apr. 15, 2014.
Extended European Search Report dated May 6, 2016 in Counterpart European Application No. 14880032.9.

* cited by examiner

GEARED CENTRIFUGAL COMPRESSOR WITH PRESSURE ADJUSTMENT PORTION TO BALANCE AXIAL THRUST

TECHNICAL FIELD

The present invention relates to a centrifugal compressor.

BACKGROUND ART

In a rotary machine such as a centrifugal compressor, gas is compressed by a centrifugal force which is generated when the gas passes through in a radial direction of a rotating impeller. As the centrifugal compressor, an uniaxial multistage centrifugal compressor having a structure in which an impeller compressing gas is attached on a single shaft, and a centrifugal compressor with a built-in speed-increasing gear (hereinafter, referred to as a geared compressor) having a structure in which impellers are attached on shaft ends of a plurality of pinion shafts are known. As the geared compressor, a type is known, in which a fluid is compressed by a plurality of compression portions having the impellers provided on the shaft ends of the plurality of pinion shafts.

As the geared compressor, for example, PTL 1 discloses a double flow geared compressor in which compression portions having the same configuration are provided on both ends of each of driven shafts which are pinion shafts to which rotation of a driving shaft is transmitted. In this geared compressor, two compression portions are rotated by one driven shaft, gas is simultaneously compressed from both sides, and the two compression portions are operated like one compression portion. Accordingly, an increase in the capacity of the entire geared compressor is realized without increasing the diameter of the impeller.

CITATION LIST

Patent Literature

[PTL 1] Japanese Unexamined Patent Application Publication No. 2013-036375

SUMMARY OF INVENTION

Technical Problem

In the above-described double flow geared compressor, it is preferable to cancel out thrust forces applied to the driven shafts from the compression portions of both ends and to realize a state where the thrust force deviated to any one side in a center axis direction is not applied to the driven shaft. However, according to an installation state of the double flow geared compressor, channel resistances may be different from each other due to differences in lengths of pipes connected to discharge ports of the compression portion. Accordingly, differences between discharge pressures in the compression portions of both sides are generated, thrust force is generated, and an unintentional load may be applied to the driven shafts or thrust bearings supporting the compression portions, or the like.

The present invention is to provide a centrifugal compressor capable of decreasing a load generated due to the difference between thrust forces generated from two compression portions.

Solution to Problem

According to a first aspect of the present invention, there is provided a centrifugal compressor, including: a driving shaft which is rotationally driven; a driving gear which is connected to the driving shaft; a driven gear to which rotation of the driving gear is transmitted; a driven shaft which extends toward both end sides in a center axis direction of the driven gear; a first compression portion which is provided on a first end portion side in the center axis direction of the driven shaft, and compresses a fluid by rotation of the driven shaft; a second compression portion which is provided on a second end portion side in the center axis direction of the driven shaft, and compresses a fluid by rotation of the driven shaft; and a pressure adjustment portion which uniformly adjusts a pressure of a space of a discharge side of the fluid in the first compression portion and a pressure of a space of a discharge side of the fluid in the second compression portion.

According to this centrifugal compressor, it is possible to decrease the difference between a discharge pressure of the first compression portion and a discharge pressure of the second compression portion. Accordingly, it is possible to decrease the thrust force which is generated due to a pressure difference between the first compression portion and the second compression portion. Therefore, it is possible to decrease a load which is generated due to the difference between thrust forces generated from two compression portions of the first compression portion and the second compression portion.

The centrifugal compressor according to a second aspect of the present invention may further include a heat exchanger which performs heat-exchange between the fluid discharged from the first compression portion and the fluid discharged from the second compression portion; a first connection line which connects a discharge port of the first compression portion and the heat exchanger; and a second connection line which connects a discharge port of the second compression portion and the heat exchanger, in which the pressure adjustment portion may connect the first connection line and the second connection line at a position in which a distance from the discharge port of the first compression portion and a distance from the discharge port of the second compression portion are the same as each other.

According to this centrifugal compressor, it is possible to cause the pressure of the space in the first connection line which is the space of the discharge side of the fluid in the first compression portion and the pressure of the space in the second connection line which is the space of the discharge side of the fluid in the second compression portion to be uniform. For example, even when a difference between the lengths of the first connection line and the second connection line is generated for convenience of layout such as an installation location of a centrifugal compressor, and the difference between pressure losses in the first connection line and the second connection line is generated, it is possible to easily decrease the difference between the discharge pressure of the first compression portion and the discharge pressure of the second compression portion. Accordingly, it is possible to easily decrease the thrust force which is generated due to a pressure difference between the first compression portion and the second compression portion. Therefore, it is possible to easily decrease a load which is generated due to the difference between thrust forces generated from two compression portions of the first compression portion and the second compression portion.

In the centrifugal compressor according to a third aspect of the present invention, the first compression portion may include a first casing which forms a first space between a first impeller which is fixed to the driven shaft, rotates along with the driven shaft, and compresses a fluid, and a surface of the second end portion side of the first impeller in the center axis direction of the driven shaft, the second compression portion may include a second casing which forms a second space between a second impeller which is fixed to the driven shaft, rotates along with the driven shaft, and compresses a fluid, and a surface of the first end portion side of the second impeller in the center axis direction of the driven shaft, and the pressure adjustment portion may be provided to penetrate the first casing and the second casing such that the first space and the second space communicate with each other.

According to the centrifugal compressor, it is possible to allow the pressure of the first space and the pressure of the second space to be uniform. Accordingly, the pressures of the channels of the suction port sides rather than the discharge ports in the first compression portion and the second compression portion approach each other so as to be uniform, and it is possible to decrease the pressure difference there between. That is, the pressure of the space in the channel of the discharge side of the fluid in the first compression portion and the pressure of the space in the channel of the discharge side of the fluid in the second compression portion can approach each other so as to be uniform with high accuracy. As a result, it is possible to further decrease a difference between the discharge pressure of the first compression portion and the discharge pressure of the second compression portion. Accordingly, by connecting the first space and the second space using the pressure adjustment portion, it is possible to easily and further decrease the thrust force which is generated due to the pressure difference between the first compression portion and the second compression portion. Therefore, it is possible to further decrease a load which is generated due to the difference between thrust forces generated from two compression portions of the first compression portion and the second compression portion.

The centrifugal compressor according to a fourth aspect of the present invention may further include a differential pressure adjustment portion which adjusts the pressure in the space of the discharge side of the first compression portion and the pressure in the space of the discharge side of the second compression portion, which are uniformly adjusted by the pressure adjustment portion, to be a predetermined differential pressure.

According to this centrifugal compressor, it is possible to adjust the difference between the pressure of the first space and the pressure of the second space in a state where the difference is uniform, and it is possible to adjust the difference so as to be a predetermined differential pressure with high accuracy. Accordingly, it is possible to easily adjust the thrust force applied to the driven shaft by the first compression portion and the second compression portion. Therefore, it is possible to cancel out the thrust force which is applied to the driven shaft, the driving shaft, or the like in addition to the thrust force due to influences of the first compression portion and the second compression portion. Accordingly, it is possible to stably operate the centrifugal compressor without applying an unnecessary load to the driven shaft or the driving shaft.

In the centrifugal compressor according to a fifth aspect of the present invention, the driving gear and the driven gear may be helical gears, and the differential pressure adjustment portion may adjust the pressures to generate a differential pressure which cancels out the thrust force generated by the driving gear and the driven gear.

According to the centrifugal compressor having this configuration, since the differential pressure which cancels out the thrust force generated by the driving gear or the driven gear configured of helical gears is generated, it is possible to cancel out the thrust force applied to the driven shaft or the driving shaft configured of helical gears, or the like. Therefore, it is possible to more stably operate the centrifugal compressor without applying an unnecessary load to the driven shaft or the driving shaft.

Advantageous Effects of Invention

According to the above-described centrifugal compressor, since it is possible to uniformly adjust the pressure of a fluid in the space of a discharge side in a first compression portion and the pressure of a fluid in the space of a discharge side in a second compression portion, it is possible to decrease a load generated due to deviation of thrust forces of the two compression portions.

DESCRIPTION OF EMBODIMENTS

First Embodiment

Hereinafter, a first embodiment of the present invention will be described with reference to FIGS. 1 and 2.

Figure 1:
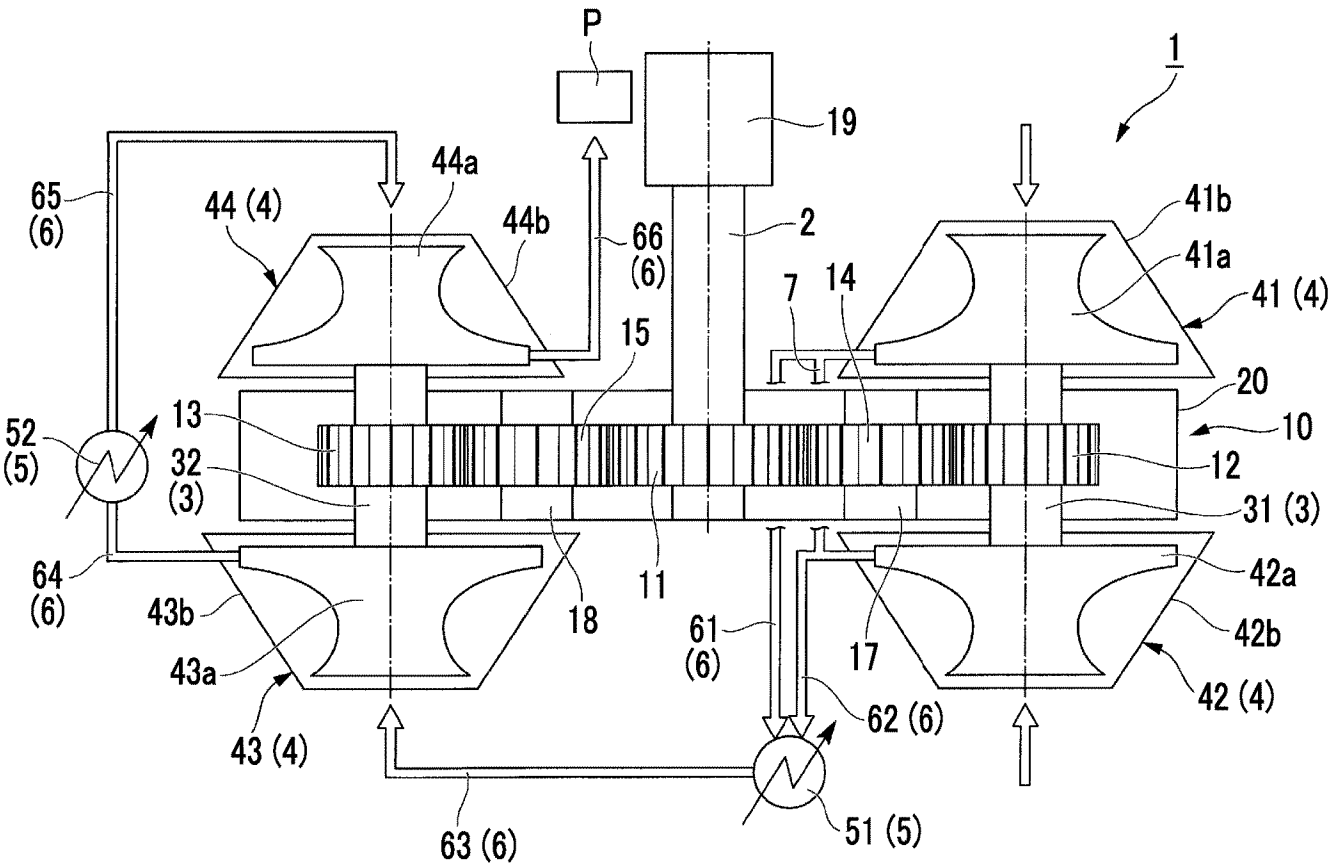
FIG. 1 is a schematic diagram showing a centrifugal compressor according to a first embodiment of the present invention.
Figure 2:
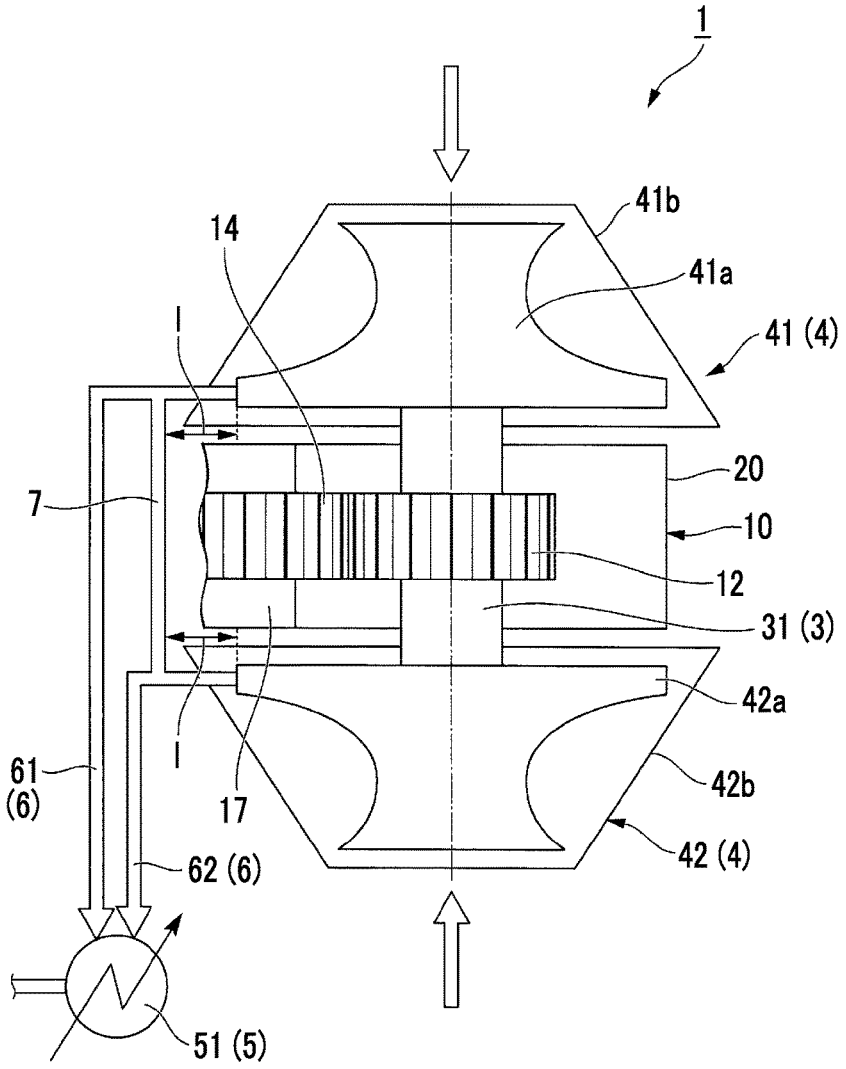
FIG. 2 is an enlarged diagram showing a first compression portion and a second compression portion of the centrifugal compressor according to the first embodiment of the present invention.

As shown in FIG. 1, a centrifugal compressor 1 of the present embodiment is a so-called geared compressor in which a speed-increasing gear 10 is built-in. The centrifugal compressor 1 of the first embodiment includes a drive source 19 which generates power, a driving shaft 2 which is rotationally driven by the drive source 19, a speed-increasing gear 10 which changes a rotation speed of the driving shaft 2 and transmits the rotation, a driven shaft 3 to which the power transmitted by the speed-increasing gear 10 is output, a plurality of compression portions 4 which are driven by the power transmitted by the driven shaft 3, a heat exchanger 5 which cools a fluid compressed by the plurality of compression portions 4, and a pipe portion 6 which is a channel of the fluid.

The driving shaft 2 is rotary shaft which is rotated around a center axis by the drive source 19.

The speed-increasing gear 10 includes a driving gear 11 which is connected to a second end portion side in a center axis direction of the driving shaft 2, and a first driven gear 12 and a second driven gear 13 to which a rotation of the driving gear 11 is transmitted. The speed-increasing gear 10 includes a first intermediate gear 14 through which the rotation of the driving gear 11 is transmitted to the first driven gear 12, and a second intermediate gear 15 through which the rotation of the driving gear 11 is transmitted to the second driven gear 13. That is, in a gear group of the speed-increasing gear 10 of the present embodiment, the second intermediate gear 15, the driving gear 11, the first intermediate gear 14, and the first driven gear 12 are disposed so as to mesh with each other in this order from the second driven gear 13. The gear group configuring the speed-increasing gear 10 is accommodated inside a casing 20. The gear group configuring the speed-increasing gear 10 in the present embodiment is configured of spur gears.

The first intermediate gear 14 is rotatably supported by a first intermediate shaft 17. In addition, the second intermediate gear 15 is rotatably supported by a second intermediate shaft 18. The first intermediate shaft 17 and the second intermediate shaft 18 are supported by the casing 20 via bearings (not shown).

The driven shaft 3 includes a first driven shaft 31 which extends to both sides in a center axis direction of the first driven gear 12, and a second driven shaft 32 which extends to both sides in a center axis direction of the second driven gear 13. The first driven shaft 31 and the second driven shaft 32 are supported by the casing 20 via bearings (not shown).

Each of the compression portions 4 compresses a fluid such as gas suctioned from a suction port toward an outer circumferential side in a radial direction of the compression portion 4 via a channel formed inside the compression portion 4, and discharges the compressed fluid. The compression portion 4 includes a first compression portion 41 which is provided on a first end portion side in a center axis direction which is a side on which the drive source 19 is provided in the first driven shaft 31, a second compression portion 42 which is provided on a second end portion side in the center axis direction which is a side opposite to the side on which the drive source 19 is provided in the first driven shaft 31, a third compression portion 43 which is provided on a second end portion side in a center axis direction in the second driven shaft 32, and a fourth compression portion 44 which is provided on a first end portion side in the center axis direction in the second driven shaft 32.

The first compression portion 41 is provided on the end portion on the first end portion side in the center axis direction of the first driven shaft 31, and compresses and circulates a fluid from a suction port toward a discharge port positioned on the outside in the radial direction by rotation of the first driven shaft 31. The first compression portion 41 is a first stage compression portion 4 in the centrifugal compressor 1. The first compression portion 41 of the present embodiment includes a first impeller 41*a* which is fixed to the first driven shaft 31, rotates along with the first driven shaft 31, and compresses a fluid, and a first casing 41*b* which covers the first impeller 41*a* to form a channel for the fluid.

The second compression portion 42 is provided on the end portion on the second end portion side in the center axis direction of the first driven shaft 31, and compresses and circulates a fluid from a suction port toward a discharge port positioned on the outside in the radial direction by rotation of the first driven shaft 31. That is, the second compression portion 42 is disposed on the end portion on the side opposite to the first compression portion 41 while the first driven shaft 31 is interposed between the first compression portion 41 and the second compression portion 42. The second compression portion 42 has a configuration similar to that of the first compression portion 41, and compresses a fluid having the same flow rate as that of the first compression portion 41 by the rotation of the first driven shaft 31. Since the second compression portion 42 compresses the fluid simultaneously with the first compression portion 41, the second compression portion 42 is the first stage compression portion 4 in the centrifugal compressor 1. The second compression portion 42 of the present embodiment includes a second impeller 42*a* which is fixed to the first driven shaft 31, rotates along with the first driven shaft 31, and compresses a fluid, and a second casing 42*b* which covers the second impeller 42*a* to form a channel for the fluid.

The third compression portion 43 is provided on the end portion on the second end portion side in the center axis direction of the second driven shaft 32, and compresses and circulates a fluid from a suction port toward a discharge port positioned on the outside in the radial direction by a rotation of the second driven shaft 32. The third compression portion 43 is a second stage compression portion 4 in the centrifugal compressor 1. The third compression portion 43 of the present embodiment includes a third impeller 43*a* which is fixed to the second driven shaft 32, rotates along with the second driven shaft 32, and compresses a fluid, and a third casing 43*b* which covers the third impeller 43*a* to form a channel for the fluid.

The fourth compression portion 44 is provided on the end portion on the second end portion side in the center axis direction of the second driven shaft 32, and compresses and circulates a fluid from a suction port toward a discharge port positioned on the outside in the radial direction by a rotation of the second driven shaft 32. That is, the fourth compression portion 44 is disposed on the end portion on the side opposite to the third compression portion 43 while the second driven shaft 32 is interposed between the third compression portion 43 and the fourth compression portion 44. The fourth compression portion 44 is a third stage compression portion 4 in the centrifugal compressor 1. The fourth compression portion 44 of the present embodiment includes a fourth impeller 44*a* which is fixed to the second driven shaft 32, rotates along with the second driven shaft 32, and compresses a fluid, and a fourth casing 44*b* which covers the fourth impeller 44*a* to form a channel for the fluid.

The heat exchanger 5 intermediately cools a fluid in a compression process, and decreases the power required for driving the centrifugal compressor 1. The heat exchanger 5 of the present embodiment includes a first heat exchanger 51 which undergoes heat exchange with fluids compressed by the first compression portion 41 and the second compression portion 42 to cool the fluids, and a second heat exchanger 52 which cools the fluid compressed by the third compression portion 43.

The first heat exchanger 51 includes two inlet nozzles and one outlet nozzle. The first stage heat exchanger 5 cools two systemic fluids discharged from the first compression portion 41 and the second compression portion 42 and combines the two systemic fluids. The first heat exchanger 51 is disposed between the first compression portion 41 and the second compression portion 42, and the third compression portion 43. The first heat exchanger 51 of the present embodiment is disposed on the second end portion side in the center axis direction of the driving shaft 2 which is positioned so as to be closer to the second compression portion 42 than the first compression portion 41.

The second heat exchanger 52 includes one inlet nozzle and one outlet nozzle. The second stage heat exchanger 5 cools a fluid discharged from the third compression portion 43 and feeds the cooled fluid to the fourth compression portion 44.

The pipe portion 6 is a pipe which forms a channel through which the fluid compressed by each compression portion 4 is circulated. The pipe portion 6 includes a first compression portion discharge pipe 61 which is connected between the first compression portion 41 and the first heat exchanger 51, a second compression portion discharge pipe 62 which is connected between the second compression portion 42 and the first heat exchanger 51, and a third compression portion suction pipe 63 which is connected between the first heat exchanger 51 and the third compression portion 43. The pipe portion 6 includes a third compression portion discharge pipe 64 which is connected between the third compression portion 43 and the second heat exchanger 52, a fourth compression portion suction pipe 65 which is connected between the second heat exchanger 52 and the fourth compression portion 44, and a fourth compression portion discharge pipe 66 which is connected between the fourth compression portion 44 and a predetermined plant P. The pipe portion 6 includes a pressure adjustment portion 7 for uniformly adjusting the pressure of the discharge port of the first compression portion 41 and the pressure of the discharge port of the second compression portion 42.

The first compression portion discharge pipe 61 is a first connection line which connects the discharge port of the first compression portion 41 and the first heat exchanger 51, and the fluid compressed by the first compression portion 41 is circulated to the first heat exchanger 51 through the first compression portion discharge pipe 61. In addition, the first compression portion discharge pipe 61 connects the discharge port of the first compression portion 41 and one of the inlet nozzles of the first heat exchanger 51.

The second compression portion discharge pipe 62 is a second connection line which connects the discharge port of the second compression portion 42 and the first heat exchanger 51, and the fluid compressed by the second compression portion 42 is circulated to the first heat exchanger 51 through the second compression portion discharge pipe 62. In addition, the second compression portion discharge pipe 62 connects the discharge port of the second compression portion 42, and one of the nozzles on a side to which the first compression portion discharge pipe 61 of the first heat exchanger 51 is not connected.

The third compression portion suction pipe 63 is a pipe which combines the fluid from the first compression portion 41 cooled by the first heat exchanger 51 and the fluid from the second compression portion 42 cooled by the first heat exchanger 51 and through which the combined fluids circulate to the third compression portion 43, and the third compression portion suction pipe 63 connects the outlet nozzle of the first heat exchanger 51 and the suction port of the third compression portion 43.

The third compression portion discharge pipe 64 is a channel through which the fluid compressed by the third compression portion 43 circulates to the second heat exchanger 52, and connects the discharge port of the third compression portion 43 and the inlet nozzle of the second heat exchanger 52.

The fourth compression portion suction pipe 65 is a pipe through which the fluid from the third compression portion 43 which is cooled by the second heat exchanger 52 circulates to the fourth compression portion 44, and is connected between the outlet nozzle of the second heat exchanger 52 and the suction port of the fourth compression portion 44.

The fourth compression portion discharge pipe 66 is a pipe through which the fluid compressed by the fourth compression portion 44 circulates to the predetermined plant P which is a supply destination of the compressed fluid, and is connected between the discharge port of the fourth compression portion 44 and a device (not shown) of the plant P.

The pressure adjustment portion 7 uniformly adjusts the pressure in the space of the discharge side of the first compression portion 41 and the pressure in the space of the discharge side of the second compression portion 42. As shown in FIG. 2, the pressure adjustment portion 7 connects the first compression portion discharge pipe 61 which is the first connection line and the second compression portion discharge pipe 62 which is the second connection line. The pressure adjustment portion 7 of the present embodiment communicates with the first compression portion discharge pipe 61 and the second compression portion discharge pipe 62 at a position at which a distance 1 from the discharge port of the first compression portion 41 in the first compression portion discharge pipe 61 to the pressure adjustment portion 7 is the same as a distance 1 from the discharge port of the second compression portion 42 in the second compression portion discharge pipe 62 to the pressure adjustment portion 7.

Next, an operation of the centrifugal compressor 1 of the first embodiment having the above-described configuration will be described.

In the centrifugal compressor 1 of the above-described embodiment, when a fluid to be compressed is simultaneously suctioned into the suction ports of the first compression portion 41 and the second compression portion 42, first stage compression is performed by the first compression portion 41 and the second compression portion 42.

Here, at the position at which the distances 1 from the discharge ports of the first compression portion 41 and the second compression portion 42 are the same as each other, the first compression portion discharge pipe 61 and the second compression portion discharge pipe 62 are connected to each other by the pipe serving as the pressure adjustment portion 7. Accordingly, a pressure in the vicinity of a location at which the pressure adjustment portion 7 is connected into the first compression portion discharge pipe 61 and a pressure in the vicinity of a location at which the pressure adjustment portion 7 is connected into the second compression portion discharge pipe 62 become uniform. That is, the pressure in a space inside the first compression portion discharge pipe 61 which is the space of the discharge side of the fluid in the first compression portion 41 and the pressure in a space inside the second compression portion discharge pipe 62 which is the space of the discharge side of the fluid in the second compression portion 42 are approximately uniform at the portion at which the pressure adjustment portion 7 is connected to the first compression portion discharge pipe 61 and the second compression portion discharge pipe 62.

In addition, here, the state where the pressures are uniform means a state where there is a pressure difference between the first compression portion 41 side and the second compression portion 42 side, in which the pressure difference is considered as not substantially influencing the first driven shaft 31 or the like.

In this state, the fluid compressed by the first compression portion 41 flows into the first compression portion discharge pipe 61 and flows into the inlet nozzle of the first heat exchanger 51. Simultaneously, the fluid compressed by the second compression portion 42 also flows into the second compression portion discharge pipe 62 and flows into the inlet nozzle of the first heat exchanger 51.

The fluids which flowed from the first compression portion discharge pipe 61 and the second compression portion discharge pipe 62 into two inlet nozzles of the first heat exchanger 51 are combined to each other in the first heat exchanger 51, and are intermediately cooled. Thereafter, when the fluid circulates through the third compression portion suction pipe 63 and flows into the suction port of the third compression portion 43, a second stage compression is performed by the third compression portion 43. The fluid compressed by the third compression portion 43 flows into the third compression portion discharge pipe 64, and flows into the second heat exchanger 52. After the fluid which has flowed into the second heat exchanger 52 is intermediately cooled in the second heat exchanger 52, the cooled fluid circulates through the fourth compression portion suction pipe 65 and flows into the suction port of the fourth compression portion 44. Thereafter, a third stage compression is performed on the fluid in the fourth compression portion 44, and the fluid is supplied to the device of the predetermined plant P which is the supply destination of the compressed fluid.

According to the above-described centrifugal compressor 1, since the pressures of the discharge sides of the fluids in the first compression portion 41 and the second compression portion 42 are made to be uniform by the pressure adjustment portion 7, it is possible to decrease the difference between the discharge pressure of the first compression portion 41 and the discharge pressure of the second compression portion 42. Accordingly, it is possible to decrease the thrust force which is generated due to the pressure difference between the first compression portion 41 and the second compression portion 42. Therefore, it is possible to decrease a load which is generated due to the difference between thrust forces generated from the two compression portions 4 of the first compression portion 41 and the second compression portion 42.

In addition, the first compression portion discharge pipe 61 and the second compression portion discharge pipe 62 are connected to each other by the pipe serving as the pressure adjustment portion 7 at the position at which the distances 1 from the discharge ports of the first compression portion 41 and the second compression portion 42 to the pressure adjustment portion 7 are the same as each other. Accordingly, it is possible to make the pressure uniform in the space inside the first compression portion discharge pipe 61 which is connected to the discharge port of the first compression portion 41 and is the space of the discharge side of the fluid in the first compression portion 41, and the pressure in the space inside the second compression portion discharge pipe 62 which is connected to the discharge port of the second compression portion 42 and is the space of the discharge side of the fluid in the second compression portion 42. For example, when a difference between lengths of the pipes of the first compression portion discharge pipe 61 and the second compression portion discharge pipe 62 is generated for convenience of layout such as an installation location of the centrifugal compressor 1, the difference between pressure losses occurs in the two pipes. That is, in this case, the difference between the pressure inside the first compression portion discharge pipe 61 and the pressure inside the second compression portion discharge pipe 62 is generated, and the difference between the discharge pressure of the first compression portion 41 and the discharge pressure of the second compression portion 42 is generated. However, since the pressures in the spaces at the positions, at which the distances 1 from the discharge ports of the first compression portion 41 and the second compression portion 42 to the pressure adjustment portion 7 are the same as each other, are made to be uniform, it is possible to easily decrease the difference between the discharge pressure of the first compression portion 41 and the discharge pressure of the second compression portion 42. Accordingly, it is possible to easily decrease the thrust force which is generated due to the pressure difference between the first compression portion 41 and the second compression portion 42. Therefore, it is possible to easily decrease a load which is generated due to the difference between thrust forces generated from the two compression portions 4 of the first compression portion 41 and the second compression portion 42.

Second Embodiment

Next, a centrifugal compressor 1 of a second embodiment will be described with reference to FIG. 3.

In the second embodiment, the same reference numerals are assigned to components common to the first embodiment, and descriptions thereof are omitted. In the centrifugal compressor 1 of the second embodiment, the connection position of the pressure adjustment portion 7 is different from that of the first embodiment.

Figure 3:
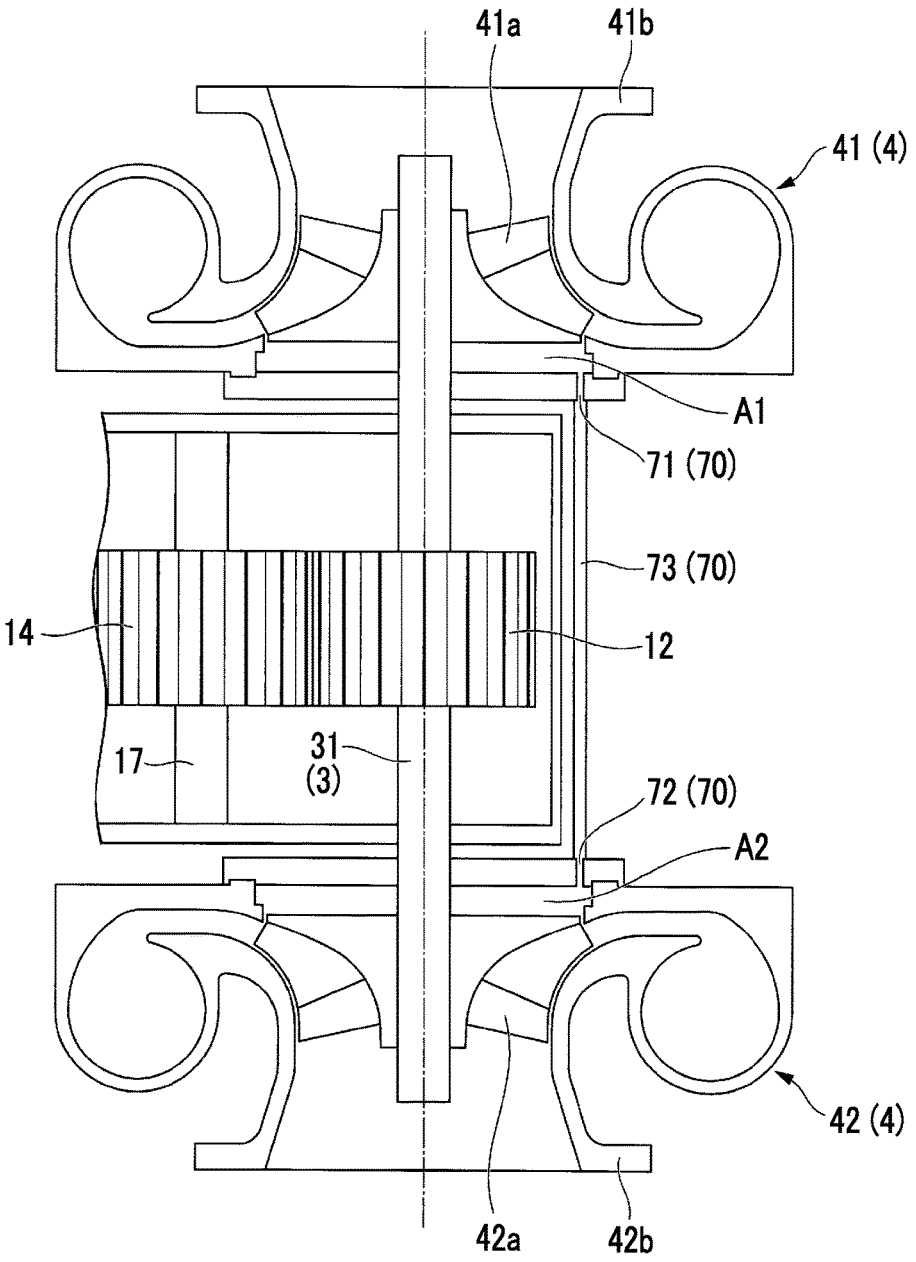
FIG. 3 is an enlarged diagram showing a first compression portion and a second compression portion of a centrifugal compressor according to a second embodiment of the present invention.

That is, as shown in FIG. 3, instead of the pressure adjustment portion 7, the centrifugal compressor 1 of the second embodiment includes a space pressure adjustment portion 70 which connects a space formed between the first impeller 41*a* and the first casing 41*b* of the first compression portion 41, and a space formed between the second impeller 42*a* and the second casing 42*b* of the second compression portion 42.

In the first compression portion 41 of the second embodiment, the first casing 41*b* is disposed so that a first space A1 is formed between the surface of the first impeller 41*a* on the second end portion side in the center axis direction of the first driven shaft 31 and the first casing 41*b*.

The first space A1 is a space inside the first casing 41*b*, and is a space which is portioned by first impeller 41*a* and a wall surface of the first casing 41*b*. The first space A1 is a space which is interposed between a bottom surface of a disk of the first impeller 41*a* on the second end portion side in the center axis direction of the first driven shaft 31, and a bottom portion of the first casing 41*b*.

In the second compression portion 42 of the second embodiment, the second casing 42*b* is disposed so that a second space A2 is formed between the surface of the second impeller 42*a* on the first end portion side in the center axis direction of the first driven shaft 31 and the second casing 42*b*.

The second space A2 is a space inside the second casing 42*b*, and is a space which is portioned by second impeller 42*a* and a wall surface of the second casing 42*b*. The second space A2 is a space which is interposed between a bottom surface of a disk of the second impeller 42*a* on the first end portion side in the center axis direction of the first driven shaft 31, and a bottom portion of the second casing 42*b*.

The space pressure adjustment portion 70 is provided so as to pass through first casing 41*b* and the second casing 42*b* so that the first space A1 and the second space A2 communicate with each other. The space pressure adjustment portion 70 of the present embodiment includes a first through-hole 71 which passes through a bottom surface of the first casing 41*b* which is the surface on the second end portion side in the center axis direction of the first driven shaft 31 in the first casing 41*b*, a second through-hole 72 which passes through a bottom surface of the second casing 42*b* which is the surface on the first end portion side in the center axis direction of the first driven shaft 31 in the second casing 42*b*, and a space pressure adjustment portion main body 73 which connects the first through-hole 71 and the second through-hole 72 and is a pipe having a small diameter of approximately 5 mm.

Next, an operation of the centrifugal compressor 1 of the second embodiment having the above-described configuration will be described.

A fluid suctioned into the suction port of the first compression portion 41 is compressed by a rotation of the first impeller 41*a*. In addition, the fluid flows toward the discharge port of the first compression portion 41. In order to rotate the first impeller 41*a* with respect to the first casing 41*b*, a minute gap is formed so that the flow of the fluid is not inhibited between the first casing 41*b* and the first impeller 41*a*. The first space A1 communicates with the channel of the discharge side of the fluid via the minute gap. Accordingly, a pressure inside the first space A1 is approximately the same as a pressure corresponding to the channel of the discharge side through which the compressed fluid circulates.

Similarly, a fluid suctioned into the suction port of the second compression portion 42 is compressed by a rotation of the second impeller 42*a*. In addition, the fluid flows toward the discharge port of the second compression portion 42. In order to rotate the second impeller 42*a* with respect to the second casing 42*b*, a minute gap is formed so that the flow of the fluid is not inhibited between the second casing 42*b* and the second impeller 42*a*. The second space A2 communicates with the channel of the discharge side of the fluid via the minute gap. Accordingly, the pressure inside the second space A2 is approximately the same as the pressure corresponding to the channel of the discharge side through which the compressed fluid circulates.

Since the first space A1 and the second space A2 communicate with each other by the pipe serving as the space pressure adjustment portion main body 73 via the first through-hole 71 and the second through-hole 72, it is possible to make the pressure of the first space A1 and the pressure of the second space A2 uniform. That is, the pressure in the space of the channel of the discharge side of the fluid in the first compression portion 41 which communicates with the first space A1 through the minute gap, and the pressure in the space of the channel of the discharge side of the fluid in the second compression portion 42 which communicates with the second space A2 through the minute gap become approximately constant. In this state, the fluid compressed by the first compression portion 41 flows into the first compression portion discharge pipe 61 and flows into the inlet nozzle of the first heat exchanger 51. Simultaneously, the fluid compressed by the second compression portion 42 also flows into the second compression portion discharge pipe 62 and flows into the inlet nozzle of the first heat exchanger 51.

According to the above-described centrifugal compressor 1, since the first space A1 and the second space A2 are connected to each other by the pipe serving as the space pressure adjustment portion main body 73 via the first through-hole 71 and the second through-hole 72, it is possible to make the pressure of the first space A1 and the pressure of the second space A2 uniform. Accordingly, pressures of the channels of the suction port sides rather than the discharge ports inside the first compression portion 41 and the second compression portion 42 approach each other so as to be uniform, and it is possible to decrease the pressure difference there between. That is, the pressure of the space in the channel of the discharge side of the fluid in the first compression portion 41 and the pressure of the space in the channel of the discharge side of the fluid in the second compression portion 42 can approach each other so as to be uniform with high accuracy. As a result, it is possible to further decrease a difference between the discharge pressure of the first compression portion 41 and the discharge pressure of the second compression portion 42. Accordingly, by connecting the first space A1 and the second space A2 using the space pressure adjustment portion main body 73, it is possible to further decrease the thrust force which is generated due to the pressure difference between the first compression portion 41 and the second compression portion 42. Therefore, it is possible to further decrease a load which is generated due to the difference between thrust forces generated from the two compression portions 4 of the first compression portion 41 and the second compression portion 42.

In addition, since each of the first space A1 and the second space A2 is a space facing the first casing 41*b* and the second casing 42*b*, it is possible to provide the space pressure adjustment portion 70 which connects the first space A1 and the second space A2 by simply providing the first through-hole 71 and the second through-hole 72 in each casing 20.

Third Embodiment

Next, a centrifugal compressor 1 of a third embodiment will be described with reference to FIG. 4.

In the third embodiment, the same reference numerals are assigned to components common to the first embodiment, and descriptions thereof are omitted. The centrifugal compressor 1 of the third embodiment is different from that of the first embodiment in that a difference is again generated between the pressures which have been made uniform by the pressure adjustment portion 7.

Figure 4:
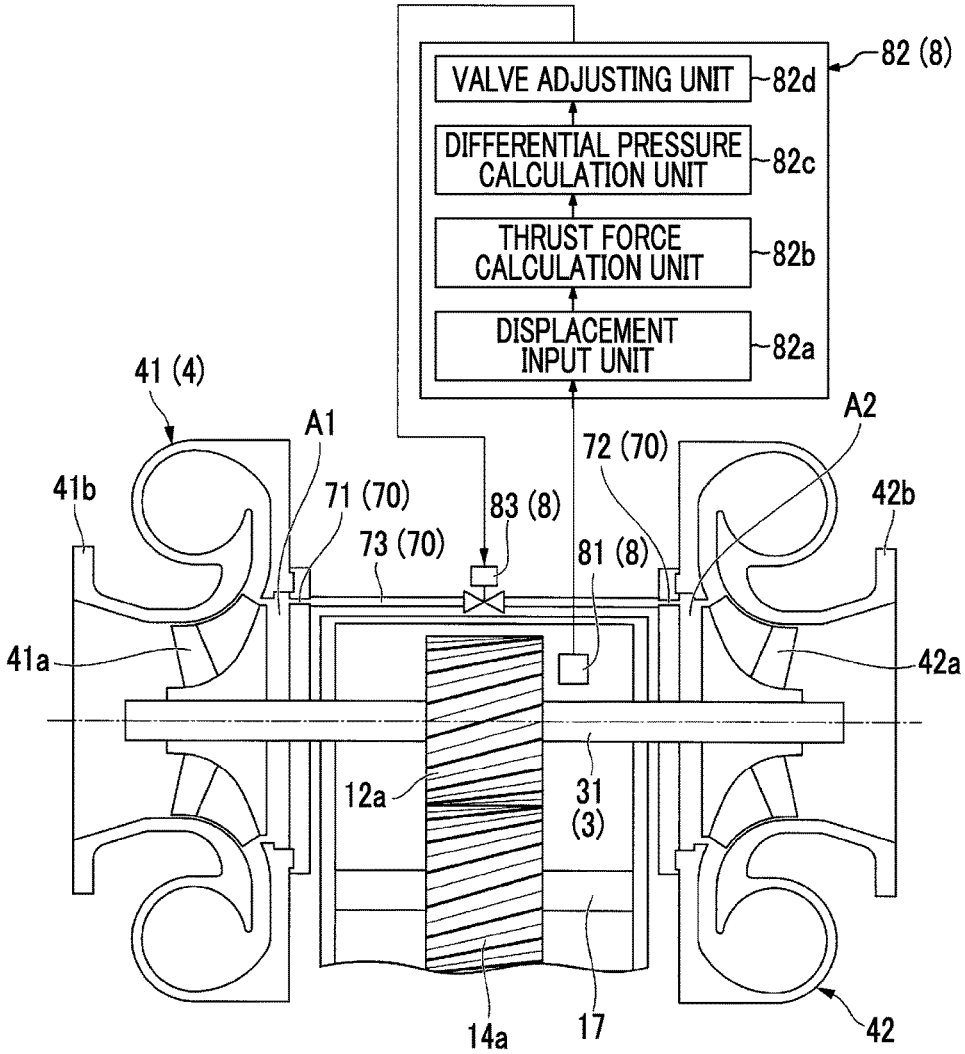
FIG. 4 is an enlarged diagram showing a first compression portion and a second compression portion of a centrifugal compressor according to a third embodiment of the present invention.

That is, as shown in FIG. 4, the centrifugal compressor 1 of the third embodiment includes the differential pressure adjustment portion 8 provided on the space pressure adjustment portion 70 of the second embodiment. In addition, a gear group of the speed-increasing gear 10 of the centrifugal compressor 1 of the present embodiment is configured of helical gears. That is, a driving gear 11*a*, a first driven gear 12*a*, a second driven gear 13*a*, a first intermediate gear 14*a*, and a second intermediate gear 15*a* all are helical gears.

The differential pressure adjustment portion 8 adjusts a differential pressure between the pressure of the space of the discharge side of the first compression portion 41 and the pressure of the space of the discharge side of the second compression portion 42 which have been uniformly adjusted by the space pressure adjustment portion 70 so as to be a predetermined differential pressure. The differential pressure adjustment portion 8 of the present embodiment adjusts the pressure of the first space A1 and the pressure of the second space A2 which are made to be uniform by the space pressure adjustment portion 70 according to the thrust force generated by the first driven shaft 31 so that a difference there between is generated. Specifically, the differential pressure adjustment portion 8 includes a displacement measurement unit 81 which measures displacement in the center axis direction of the first driven shaft 31, a differential pressure control unit 82 which calculates a predetermined differential pressure based on the measured displacement of the first driven shaft 31, and a valve portion 83 which adjusts an opening amount of the space pressure adjustment portion main body 73 based on calculation results of the differential pressure control unit 82.

The displacement measurement unit 81 measures a relative displacement amount of the first driven shaft 31 with respect to the casing 20 in the center axis direction using a displacement sensor installed in the casing 20. The displacement measurement unit 81 outputs measurement results to the differential pressure control unit 82.

The differential pressure control unit 82 includes a displacement input unit 82*a* to which the measurement results of the displacement measurement unit 81 are input, a thrust force calculation unit 82*b* which calculates thrust force applied to the first driven shaft 31 based on the input displacement, a differential pressure calculation unit 82*c* which calculates a differential pressure between the first space A1 and the second space A2 based on the thrust force calculated by the thrust force calculation unit 82*b*, and a valve adjusting unit 82*d* which instructs an opening amount to the valve portion 83 based on the calculation results of the differential pressure calculation unit 82*c*.

Information of the relative displacement amount in the center axis direction of the first driven shaft 31 with respect to the casing 20 measured by the displacement measurement unit 81 is input to the displacement input unit 82*a*. The displacement input unit 82*a* sends the input information of the relative displacement amount to the thrust force calculation unit 82*b*.

The thrust force calculation unit 82*b* calculates how much thrust force is applied to the first driven shaft 31, based on the received information of the relative displacement amount. The thrust force calculation unit 82*b* sends the calculated thrust force to the differential pressure calculation unit 82*c*.

The differential pressure calculation unit 82*c* calculates a differential pressure between the pressure of the first space A1 and the pressure of the second space A2 to cancel out the thrust force generated in the first driven shaft 31 by the first driven gear 12*a* connected to the first driven shaft 31 via the driving gear 11*a* and the first intermediate gear 14*a* of the speed-increasing gear 10, based on the received thrust force. The differential pressure calculation unit 82*c* sets the calculated differential pressure to a predetermined differential pressure, and sends information with respect to the predetermined differential pressure to the valve adjusting unit 82*d*.

The valve adjusting unit 82*d* calculates an opening amount of the valve portion 83 based on the received information of the predetermined differential pressure, and sends signals which instruct the valve portion 83 so as to be opened by the calculated opening amount to the valve portion 83.

The valve portion 83 is provided in the middle of the pipe which is the space pressure adjustment portion main body 73. The valve portion 83 adjusts a flow rate of the pipe by opening and closing a valve based on the signals input from the valve adjusting unit 82*d*.

Next, an operation of the centrifugal compressor 1 of the third embodiment having the above-described configuration will be described.

In the centrifugal compressor 1 of the third embodiment, since the gear group configuring the speed-increasing gear 10 is configured of helical gears, while the rotation of the driving shaft 2 is transmitted, thrust force is applied to the first intermediate gear 14*a*, the first driven gear 12*a*, or the like in any one direction in the center axis direction. That is, thrust force is applied to the first driven shaft 31 connected to the first driven gear 12*a* in any one direction in the center axis direction. As a result, the first driven shaft 31 moves to either the first end portion side or the second end portion side in the center axis direction with respect to the casing 20.

When the first driven shaft 31 moves, the relative displacement amount of the first driven shaft 31 with respect to the casing 20 in the center axis direction is measured by the displacement measurement unit 81 provided in the casing 20. The displacement measurement unit 81 outputs the information of the measured relative displacement amount to the displacement input unit 82*a* of the differential pressure control unit 82. The displacement input unit 82*a* to which the information of the relative displacement amount is input sends the input information to the thrust force calculation unit 82*b*. The thrust force calculation unit 82*b* calculates the thrust force applied to the first driven shaft 31 by the gear group of the speed-increasing gear 10, based on the received information of the displacement amount. The thrust force calculation unit 82*b* sends the information of the calculated thrust force to the differential pressure calculation unit 82*c*. The differential pressure calculation unit 82*c* calculates the difference between the pressure of the first space A1 and the pressure of the second space A2, which is the differential pressure for canceling out the thrust force applied to the first driven shaft 31, as a predetermined differential pressure, based on the received information of the thrust force. The differential pressure calculation unit 82*c* sends the information of the calculated predetermined differential pressure to the valve adjusting unit 82*d*. The valve adjusting unit 82*d* calculates the opening amount of the valve portion 83 based on the received information of the predetermined differential pressure, and sends signals with respect to instruction to the valve portion 83. The valve portion 83 which has received the signals adjusts an amount of fluid communicating with the pipe which is the space pressure adjustment portion main body 73 so that the instructed opening amount is realized. As a result, the pressures of the first space A1 and the second space A2 are deviated from each other by a predetermined differential pressure.

In this state, a fluid compressed by the first compression portion 41 flows in the first compression portion discharge pipe 61 and flows into the inner nozzle of the first heat exchanger 51. Simultaneously, a fluid compressed by the second compression portion 42 also flows in the second compression portion discharge pipe 62 and flows into the inner nozzle of the first heat exchanger 51. A difference between the thrust force applied to the first driven shaft 31 from the first compression portion 41 and the thrust force applied to the first driven shaft 31 from the second compression portion 42 is generated by the discharge pressure discharged by the fluid compressed by the first compression portion 41 and the discharge pressure discharged by the fluid compressed by the second compression portion 42. The first driven shaft 31 moves toward a side having a smaller thrust force in the center axis direction. Accordingly, while the rotation of the driving shaft 2 is transmitted to the first driven shaft 31, the first driven shaft 31 is returned to a position before the first driven shaft 31 is moved from the speed-increasing gear 10 configured of helical gears by the applied thrust force.

According to the above-described centrifugal compressor 1, the opening amount of the valve portion 83 is adjusted so that the pressure of the first space A1 and the pressure of the second space A2 uniformly adjusted by the space pressure adjustment portion 70 is a predetermined differential pressure calculated by the differential pressure calculation unit 82*c*. As a result, it is possible to adjust the difference between the pressure of the first space A1 and the pressure of the second space A2 from a uniform state, and it is possible to adjust the difference with high accuracy so as to be a predetermined differential pressure. Accordingly, it is possible to easily adjust the thrust force which is applied to the first driven shaft 31 by the first compression portion 41 and the second compression portion 42. Therefore, it is possible to easily cancel out the thrust force which is applied to the first driven shaft 31, the driving shaft 2 connected to the first driven shaft 31, or the like in addition to the thrust force due to influences of the first compression portion 41 and the second compression portion 42. Accordingly, it is possible to stably operate the centrifugal compressor without applying an unnecessary load to the first driven shaft 31 which is the speed-increasing gear 10 or the driving shaft 2.

In addition, when the gear group such as the driving gear 11*a* or the first driven gear 12*a* is configured of helical gears, by setting the predetermined differential pressure calculated by the differential pressure calculation unit 82*c* to the differential pressure which cancels out the thrust force generated by the gear group, it is possible to cancel out the thrust force applied to the first driven shaft 31, the driving shaft 2 connected to the first driven shaft 31, or the like using the helical gears. Accordingly, it is possible to stably operate the centrifugal compressor without applying an unnecessary load to the first driven shaft 31 or the driving shaft 2.

Hereinbefore, the embodiments of the present invention are described with reference to the drawings. However, configurations and combinations thereof in each embodiment are examples, and additions, omission, replacement, and other modifications of the configurations may be performed within a scope which does not depart from the gist of the present invention. In addition, the present invention is not limited by the embodiments, and is limited by only claims.

Moreover, the compression portion 4 is not limited to the three stage configuration unlike the centrifugal compressor 1 of the present embodiment. That is, a two stage configuration in which the fourth compression portion 44 is not present may be adopted, and a configuration having four stages or more in which a fifth compression portion or a sixth compression portion is provided may be adopted.

INDUSTRIAL APPLICABILITY

According to the centrifugal compressor, since it is possible to uniformly adjust a pressure of a fluid in a space of a discharge side in a first compression portion and a pressure of a fluid in a space of a discharge side in a second compression portion, it is possible to decrease a load generated due to deviation of thrust forces of the two compression portions.

REFERENCE SIGNS LIST

1: CENTRIFUGAL COMPRESSOR
19: DRIVE SOURCE
2: DRIVING SHAFT
10: SPEED-INCREASING GEAR
11, 11*a*: DRIVING GEAR
12, 12*a*: FIRST DRIVEN GEAR
13, 13*a*: SECOND DRIVEN GEAR
14, 14*a*: FIRST INTERMEDIATE GEAR
15, 156*a*: SECOND INTERMEDIATE GEAR
17: FIRST INTERMEDIATE SHAFT
18: SECOND INTERMEDIATE SHAFT
20: CASING
3: DRIVEN SHAFT
31: FIRST DRIVEN SHAFT
32: SECOND DRIVEN SHAFT
4: COMPRESSION PORTION
41: FIRST COMPRESSION PORTION
41*a*: FIRST IMPELLER
41*b*: FIRST CASING
42: SECOND COMPRESSION PORTION
42*a*: SECOND IMPELLER
42*b*: SECOND CASING
43: THIRD COMPRESSION PORTION
43*a*: THIRD IMPELLER
43*b*: THIRD CASING
44: FOURTH COMPRESSION PORTION
44*a*: FOURTH IMPELLER
44*b*: FOURTH CASING
5: HEAT EXCHANGER
51: FIRST HEAT EXCHANGER
52: SECOND HEAT EXCHANGER
6: PIPE PORTION
61: FIRST COMPRESSION PORTION DISCHARGE PIPE
62: SECOND COMPRESSION PORTION DISCHARGE PIPE
63: THIRD COMPRESSION PORTION SUCTION PIPE
64: THIRD COMPRESSION PORTION DISCHARGE PIPE
65: FOURTH COMPRESSION PORTION SUCTION PIPE
66: FOURTH COMPRESSION PORTION DISCHARGE PIPE
7: PRESSURE ADJUSTMENT PORTION
1: DISTANCE (FROM DISCHARGE PORT)
70: SPACE PRESSURE ADJUSTMENT PORTION
71: FIRST THROUGH-HOLE
72: SECOND THROUGH-HOLE
73: SPACE PRESSURE ADJUSTMENT PORTION MAIN BODY
A1: FIRST SPACE
A2: SECOND SPACE
8: DIFFERENTIAL PRESSURE ADJUSTMENT PORTION
81: DISPLACEMENT MEASUREMENT UNIT
82: DIFFERENTIAL PRESSURE CONTROL UNIT
82*a*: DISPLACEMENT INPUT UNIT
82*b*: THRUST FORCE CALCULATION UNIT
82*c*: DIFFERENTIAL PRESSURE CALCULATION UNIT
82*d*: VALVE ADJUSTING UNIT
83: VALVE PORTION
P: PLANT

The invention claimed is:

1. A centrifugal compressor, comprising:
a driving shaft which is rotationally driven;
a driving gear which is connected to the driving shaft;
a driven gear to which rotation of the driving gear is transmitted;
a driven shaft which extends toward both end sides in a center axis direction of the driven gear;
a first compression portion which is provided on a first end portion of the driven shaft in the center axis direction thereof, and compresses a fluid by rotation of the driven shaft and discharges the compressed fluid;
a second compression portion which is provided on a second end portion of the driven shaft in the center axis direction thereof so as to be disposed opposite to the first compression portion with the driven shaft interposed therebetween, and compresses a fluid by rotation of the driven shaft and discharges the compressed fluid;
wherein an axial flow into and within the first compression portion is in a direction opposite an axial flow into and within the second compression portion along the center axis direction of the driven gear; and further comprising:

a pressure adjustment portion which uniformly adjusts a pressure of a space of a discharge side of the fluid in the first compression portion and a pressure of a space of a discharge side of the fluid in the second compression portion; and a heat exchanger which cools the fluid discharged from the first compression portion and the fluid discharged from the second compression portion;

a first connection line which connects a discharge port of the first compression portion and the heat exchanger; and a second connection line which connects a discharge port of the second compression portion and the heat exchanger, wherein the pressure adjustment portion connects the first connection line and the second connection line at a position in which a distance from the discharge port of the first compression portion and a distance from the discharge port of the second compression portion are the same as each other.

2. The centrifugal compressor according to claim 1, further comprising:

a differential pressure adjustment portion which adjusts the pressure in the space of the discharge side of the first compression portion and the pressure in the space of the discharge side of the second compression portion, which are uniformly adjusted by the pressure adjustment portion, to be a predetermined differential pressure.

3. A centrifugal compressor, comprising:

a driving shaft which is rotationally driven;

a driving gear which is connected to the driving shaft;

a driven gear to which rotation of the driving gear is transmitted;

a driven shaft which extends toward both end sides in a center axis direction of the driven gear;

a first compression portion which is provided on a first end portion of the driven shaft in the center axis direction thereof, and compresses a fluid by rotation of the driven shaft and discharges the compressed fluid;

a second compression portion which is provided on a second end portion of the driven shaft in the center axis direction thereof so as to be disposed opposite to the first compression portion with the driven shaft interposed therebetween, and compresses a fluid by rotation of the driven shaft and discharges the compressed fluid;

wherein an axial flow into and within the first compression portion is in a direction opposite an axial flow into and within the second compression portion along the center axis direction of the driven gear; and further comprising:

a pressure adjustment portion which uniformly adjusts a pressure of a space of a discharge side of the fluid in the first compression portion and a pressure of a space of a discharge side of the fluid in the second compression portion;

wherein the first compression portion includes a first casing which forms a first space between a first impeller which is fixed to the driven shaft, rotates along with the driven shaft, and compresses a fluid, and a surface of the second end portion side of the first impeller in the center axis direction of the driven shaft, wherein the second compression portion includes a second casing which forms a second space between a second impeller which is fixed to the driven shaft, rotates along with the driven shaft, and compresses a fluid, and a surface of the first end portion side of the second impeller in the center axis direction of the driven shaft, and wherein the pressure adjustment portion is provided to penetrate the first casing and the second casing such that the first space and the second space communicate with each other.

4. The centrifugal compressor according to claim 3, further comprising:

a differential pressure adjustment portion which adjusts the pressure in the space of the discharge side of the first compression portion and the pressure in the space of the discharge side of the second compression portion, which are uniformly adjusted by the pressure adjustment portion, to be a predetermined differential pressure.

5. A centrifugal compressor, comprising:

a driving shaft which is rotationally driven;

a driving gear which is connected to the driving shaft;

a driven gear to which rotation of the driving gear is transmitted;

a driven shaft which extends toward both end sides in a center axis direction of the driven gear;

a first compression portion which is provided on a first end portion of the driven shaft in the center axis direction thereof, and compresses a fluid by rotation of the driven shaft and discharges the compressed fluid;

a second compression portion which is provided on a second end portion of the driven shaft in the center axis direction thereof so as to be disposed opposite to the first compression portion with the driven shaft interposed therebetween, and compresses a fluid by rotation of the driven shaft and discharges the compressed fluid;

wherein an axial flow into and within the first compression portion is in a direction opposite an axial flow into and within the second compression portion along the center axis direction of the driven gear; and further comprising:

a pressure adjustment portion which uniformly adjusts a pressure of a space of a discharge side of the fluid in the first compression portion and a pressure of a space of a discharge side of the fluid in the second compression portion; and a differential pressure adjustment portion which adjusts the pressure in the space of the discharge side of the first compression portion and the pressure in the space of the discharge side of the second compression portion, which are uniformly adjusted by the pressure adjustment portion, to be a predetermined differential pressure.

6. The centrifugal compressor according to claim 5, wherein the driving gear and the driven gear are helical gears, and wherein the differential pressure adjustment portion adjusts the pressures to generate a differential pressure which cancels out thrust force generated by the driving gear and the driven gear.

* * * * *